United States Patent [19]

Speller

[11] Patent Number: 4,485,876

[45] Date of Patent: Dec. 4, 1984

[54] VALVING APPARATUS FOR DOWNHOLE TOOLS

[75] Inventor: David J. Speller, Houston, Tex.

[73] Assignee: Baker Oil Tools, Inc., Orange, Calif.

[21] Appl. No.: 535,405

[22] Filed: Sep. 26, 1983

[51] Int. Cl.[3] ..... E21B 34/10

[52] U.S. Cl. ..... 166/373; 166/321

[58] Field of Search ..... 166/373, 318–324, 166/374, 382, 386, 387, 120–122, 129–131

[56] References Cited

U.S. PATENT DOCUMENTS 3,054,450 9/1962 Baker ..... 166/120

3,375,874 4/1968 Cherry et al. ..... 166/321 X

*Primary Examiner*—James A. Leppink

*Assistant Examiner*—Thuy M. Bui

*Attorney, Agent, or Firm*—Norvell & Associates

[57] ABSTRACT

A valving apparatus supplies increased fluid pressure to a downhole tool having fluid pressure actuated expandable packing elements. The valving apparatus includes upper and lower annular sealing surfaces and a shuttle valve which, in its normal spring biased position, engages the upper sealing surface and maintains a connection between the bore of the downhole tool and the casing annulus, thereby equalizing pressure therebetween. When pressure in the work string is increased through dropping of a ball on a seat contained in the valving apparatus, the increased fluid pressure is bypassed around the ball valve to impinge upon a piston surface incorporated on the shuttle valve, moving the shuttle valve downwardly into sealing engagement with the lower annular sealing surface and thus transmitting increased pressure to the downhole tool. Upon release of the increased pressure, the shuttle valve returns to its normal position in sealing engagement with the upper annular sealing surface and opens the fluid flow connection between the interconnected bores of the valving apparatus and the downhole tool and the casing annulus.

19 Claims, 15 Drawing Figures

VALVING APPARATUS FOR DOWNHOLE TOOLS

BACKGROUND OF THE INVENTION

1. Field of the Invention

The invention relates to a valving apparatus for connection between a tubular work string and a downhole well tool having a fluid pressure expandable packing element.

2. Description of the Prior Art

There are many downhole tools which incorporate fluid pressure actuated expandable packing elements which are expanded into sealing engagement with the wall of the casing through the application of fluid pressure through the bore of an interconnected tubular work string. When the fluid level in the well is sufficiently high that the hydrostatic pressure existing in the casing annulus is substantially equal to the hydrostatic pressure represented by the column of fluid contained in the interconnected work string and tool, then no problems are encountered in the direct application of fluid pressure to the expandable packing element of the tool. On the other hand, in wells having a low fluid level, the hydrostatic pressure existing in the casing annulus at the time that it is desired to release the expandable packing element from engagement with the casing wall, may often be substantially less than the hydrostatic pressure existing in the interconnected work string and the central bore of the tool. Under these circumstances, it is impossible to effect the contraction of the expandable packing elements since they are subject to the aforementioned pressure differential and maintained by such pressure differential in their expanded position.

The prior art is devoid of a simple, reliable apparatus for effecting the supply of fluid pressure through the bore of a tool to effect the expansion of a fluid pressure actuated packing element, and at the same time, when such pressure is released, to effect the equalization of pressure between the bore of the tool and the casing annulus to permit the expandable packing elements to retract to their normal run-in positions, free of engagement with the casing wall.

SUMMARY OF THE INVENTION

This invention provides a valving apparatus for connection intermediate a tubular conduit, such as a tubular work string, and a downhole tool having fluid pressure actuated expandable packing elements engageable with the casing wall through the application of an increased pressure through the interconnected bores of the work string, the valving apparatus, and the downhole tool.

The valving apparatus involving this invention employs a pair of vertically spaced, annular sealing surfaces which are disposed in relatively fixed relationship within a tubular body assemblage. A tubular shuttle valve is mounted in the tubular body assemblage for limited vertical movement between an upper position wherein an annular valving surface on the shuttle valve engages the upper valving surface in sealing relationship and a lower position wherein a second annular sealing surface on the shuttle valve engages the lower annular valving surface in sealing relationship.

A spring is provided to maintain the shuttle valve normally in its uppermost position. In this position, a through passage is provided through the bore of the valving apparatus and the interconnected work string so that the tool and valving apparatus may be readily run into the well. Also, a gap exists between the lower annular valve surface and the shuttle valve, thus providing fluid communication with the casing annulus. After the tool is positioned at its desired location in the well, and fluid pressure actuation of the tool is desired, a ball is dropped through the work string to seat on a conical surface provided in the valving apparatus at a position above the upper valving surface. This permits fluid pressure to be built up in the work string and such fluid pressure exits through a radial port in the tubular assemblage to bypass the ball valve and enter a fluid pressure chamber including the uppermost portions of the shuttle valve, which function as a piston. The effect of the increased fluid pressure on the piston portions of the shuttle valve forces the shuttle valve downwardly, against the spring bias, to concurrently open a gap between the upper valving surface and effect a sealing relationship with the lower valving surface. Thus, the increased fluid pressure is passed freely through the valving apparatus to the downhole tool.

Upon completion of the particular operation with the downhole tool, such as a perforation washing operation, the fluid pressure is removed from the work string and the fluid pressure in the interconnected bores of the work string, valving apparatus, and downhole tool is permitted to return to normal hydrostatic levels. Such decrease in fluid pressure removes the fluid pressure force on the piston portion of the shuttle, permitting the shuttle valve to be moved upwardly under the bias of its spring, thus returning to its run-in position and opening a gap between the lower sealing surface and the shuttle valve. A radial port passing through the walls of the tubular assemblage and connecting with the casing annulus is disposed adjacent the aforementioned gap, and thus effects a fluid pressure equalization flow between the interconnected bores of the tool and the valving apparatus and the casing annulus, thereby equalizing the casing annulus fluid pressure with that existing in the bore of the downhole tool. Such equalization permits the influence of their own resilience and removes the packing elements from engagement with the casing wall to permit removal of the tool, or movement of the tool to another area of the well for further use.

Further advantages of the invention will be readily apparent to those skilled in the art from the following detailed description, taken in conjunction with the annexed sheets of drawings on which is shown a preferred embodiment of the invention.

DESCRIPTION OF THE PREFERRED EMBODIMENT

While the valving apparatus involving this invention may be employed for controlling the application of fluid pressure to any type of expandable packing element disposed in an annulus defined between two concentric well conduits, for simplicity of understanding, the invention will be described in connection with the control of fluid pressure to a conventional perforation washer 20 which is suspended on the end of the valving apparatus 10 and inserted within the wall casing 1 by a tubular work string 3. These elements define an annulus 1*a* between the inner wall of the casing 1 and the outer wall of the interconnected apparatus including perforation washer 20, valving apparatus 10, and tubular work string 3.

Figure 1:
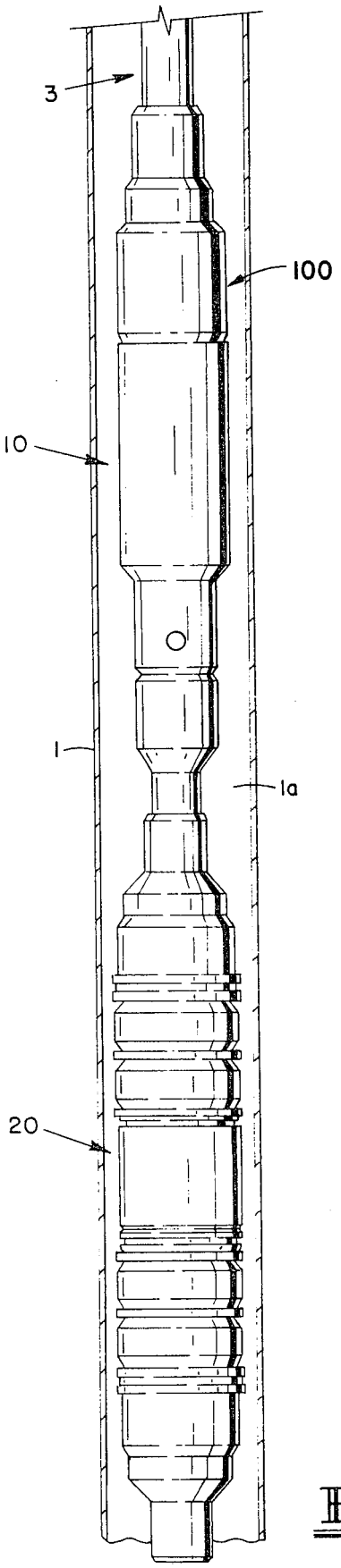
FIG. 1 is a schematic elevational view of a valving apparatus involving this invention, shown in assembled relationship to a perforation washer and mounted within the casing of the well.
Figure 3A:
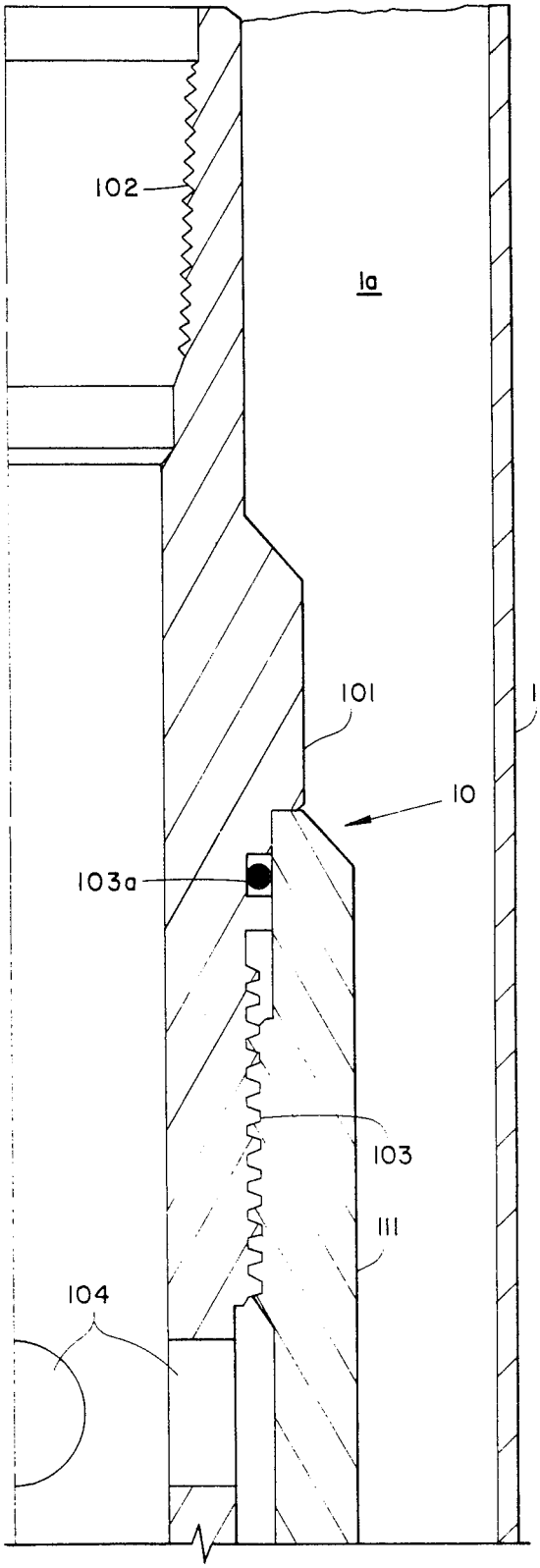
FIGS. 3A–3G are views respectively similar to views 2A–2G but showing the elements of the apparatus in their operative positions when the packing elements of the perforation washer are expanded into engagement with the well casing.

Referring now to the enlarged scale drawings of FIGS. 2A–2G, the valving apparatus 10 will be seen to comprise a tubular body assemblage 100 (FIG. 1) formed by the threaded interconnection of an upper body element 101, two intermediate body elements 111 and 121, and a lower body element 131. Upper body element 101 is provided with internal threads 102 for connection to the tubular work string 3 or any other suitable well conduit. Upper body element 101 is further provided on its medial portion with external threads 103 for threadably receiving the upper end of the intermediate body element 111. This threaded juncture is sealed by an O-ring seal 103*a*. Intermediate body member 111 is provided at its lower end with external threads 112 for threadable attachment to the top end of the lower intermediate body element 121. The bottom portion of the intermediate body element 121 is provided with external threads 122 for threadable connection to a lower body element 131. Body element 131 has threads 132 connecting to the top end 201 of the perforation washer unit 20.

The medial portion of the upper tubular body element 101 is further provided with a plurality of radial ports 104. These ports are located immediately above an upwardly facing conical sealing surface 105 which, as will be later described, is constructed to receive a ball or similar type of plug valve in sealing relationship when such plug valve is dropped through the work string 3.

At the extreme bottom end of the upper tubular body element 101, a seal mounting sleeve 106 is provided which defines an external channel 106*a* for the mounting therein of an annular elastomeric mass 107 of sealing material. Both the seal mounting sleeve 106 and the elastomeric mass 107 are secured to the bottom portion of the upper tubular body element 101 by a retaining sleeve 108 which engages threads 101*a* provided on the upper tubular body portion 101. The elastomeric mass 107 will thus be seen to provide an annular, downwardly facing sealing surface 107*a*. An O-ring 106*b* seals the abutting end face connection between the seal mounting sleeve 106 and the bottom end of the upper tubular body 101.

The upper intermediate tubular body element 111 is spaced outwardly relative to the lower portions of the upper tubular body element 101 to define an annulus 111*a* therebetween. Near the bottom of the threads 112, the intermediate tubular body element 11 is provided with an internally projecting shoulder portion 113 defining a cylindrical bearing surface 113*a*. As will be later described, this bearing surface 113*a* slidably cooperates with an external cylindrical bearing surface 50*a* provided on a tubular shuttle valve 50. An O-ring seal 113*b* effects a seal with the bearing surface 50*a* of the shuttle valve 50 so that a fluid pressure chamber is defined by annulus 111*a*.

The lower end of the lower intermediate tubular body element 121 defines an internal cylindrical bearing surface 123 which slidably cooperates with the external cylindrical surface 51*a* of a sleeve 51 which is secured to the bottom end of the shuttle valve 50 in a manner to be hereinafter described. Additionally, the lower tubular body 121 is provided with axially spaced, radial ports 125 and 126 to maintain the annulus 124 between the exterior of the shuttle valve 50 and the interior bore surface 123 of the intermediate body element 121 at the same fluid pressure as the casing annulus 1*a*.

A sealing sleeve 117 is slidably mounted within the lower portion of the lower intermediate tubular body element 121 and is maintained in an upper position by a spring 118 acting against the bottom of the sealing sleeve 117 and an internal shoulder 133 defined just below the threads 122 providing the connection to the lower tubular body element 131. An enlarged shoulder 117*a* on sealing sleeve 117 cooperates with an internally projecting, downwardly facing shoulder 121*c* provided on the intermediate tubular body element 121. The top portion of the sealing sleeve 117 defines an upstanding beaded ridge 117*b* which functions as a sealing surface and cooperates with an annular elastomeric mass 55 provided on the bottom of the shuttle valve 50, in a manner to be hereinafter described.

A first seal support sleeve 51 (FIG. 2C) is mounted around the lower portions of the tubular body of the shuttle valve 50 and is secured in the desired axial position by a C-ring 52. The first seal support sleeve 51 is provided with a lower externally threaded portion 51*b* which cooperates with internal threads provided on a second seal retainer sleeve 53. A third seal support sleeve 54 is sealably mounted on the bottom of shuttle valve 50 and sealed thereto by an O-ring 54*a*. The lower portions of sleeves 53 and 54 are shaped to define a recess for receiving the annular elastomeric sealing mass 55 and retaining such mass in position to be engaged by the upstanding sealing ridge 117*b* whenever the shuttle valve 50 is moved downwardly.

The upper end of the tubular shuttle valve 50 is provided with an enlarged counterbored portion 50*b* (FIG. 2B) and a sealing sleeve 56 is secured thereto by a set screw 57 and sealed to the counterbore by an O-ring seal 58. The sealing sleeve 56 is provided at its upper end with an upstanding annular ridge sealing member 56*a* which cooperates with the annular elastomeric mass 107 to achieve a sealing engagement therewith whenever the shuttle valve 50 is in its uppermost position, as illustrated in FIG. 1B. The outer upwardly facing surfaces of valve 50 and sleeve 56 constitute piston surfaces disposed in the annulus 111*a*.

Shuttle 50 is resiliently biased to remain in its uppermost position by a helical spring 60 which surrounds the medial portion of the tubular shuttle valve 50 and abuts at its upper end against a ring 61 which in turn abuts against a downwardly facing shoulder 50*c* provided on the tubular shuttle valve 50. At its lower end, spring 60 abuts a ring 62 which is supported by a plurality of spacer rings 63. The number of spacer rings employed and the axial height of each depends upon the amount of pressure that is selected to maintain the shuttle valve in its closed upper position with respect to the downwardly facing elastomeric seal 107. Spacer rings 63 are in turn supported on an upwardly facing shoulder 121*d* provided on the intermediate tubular body portion 121. Thus, a valving apparatus involving this invention includes a tubular assembly connectable in series relation between a surface connected well conduit and the central bore of a downhole tool. Such tubular assembly defines a first fluid passage at its upper end communicating with the bore of the well conduit and a second fluid passage at its lower end communicating with the central bore of the well tool. Additionally, a radial port, such as port 126, provides fluid communication between the casing annulus and the central bore of the tubular assembly. The reciprocal movements of the shuttle valve 50 establishes in one position direct fluid communication through the aforementioned port between the casing annulus and the central bore of the downhole tool. In a second position, the shuttle valve establishes fluid communication between the bore of the well conduit and the central bore of the downhole tool to transmit pressured fluid to the downhole tool.

As previously mentioned, valving apparatus 10 embodying this invention is series connected between the tubular work string 3 and a downhole tool, such as a perforation washing tool 20. This invention may be advantageously employed with any type of downhole tool wherein a fluid pressure actuated expandable packing element is expanded into sealing engagement across the annulus 1*a*. The washing tool 20 illustrated in the drawings is entirely conventional, and may, for example, comprise a Model C Packing Element Circulating Washer sold by Baker Service Tools Division of Baker International Corporation of Los Angeles, Calif. Accordingly, no detailed description of the construction of such tool will be made beyond pointing out the major components thereof.

Thus, the tool 20 comprises an outer hollow housing 201 on which are mounted a plurality of expandable elastomeric sealing elements 202, 203, 204 and 205. These elastomeric elements are concurrently axially compressed through the expansion of two telescopically related piston elements 210 and 211. Pressurized fluid for axially separating the piston elements 210 and 211 is supplied to a fluid pressure chamber 212 defined between the two telescopically related piston elements, through a radial port 213 which communicates with the hollow bore 20*a* of the washing tool 20, hence with the bore of the tubular housing assemblage 100.

Figure 2A:
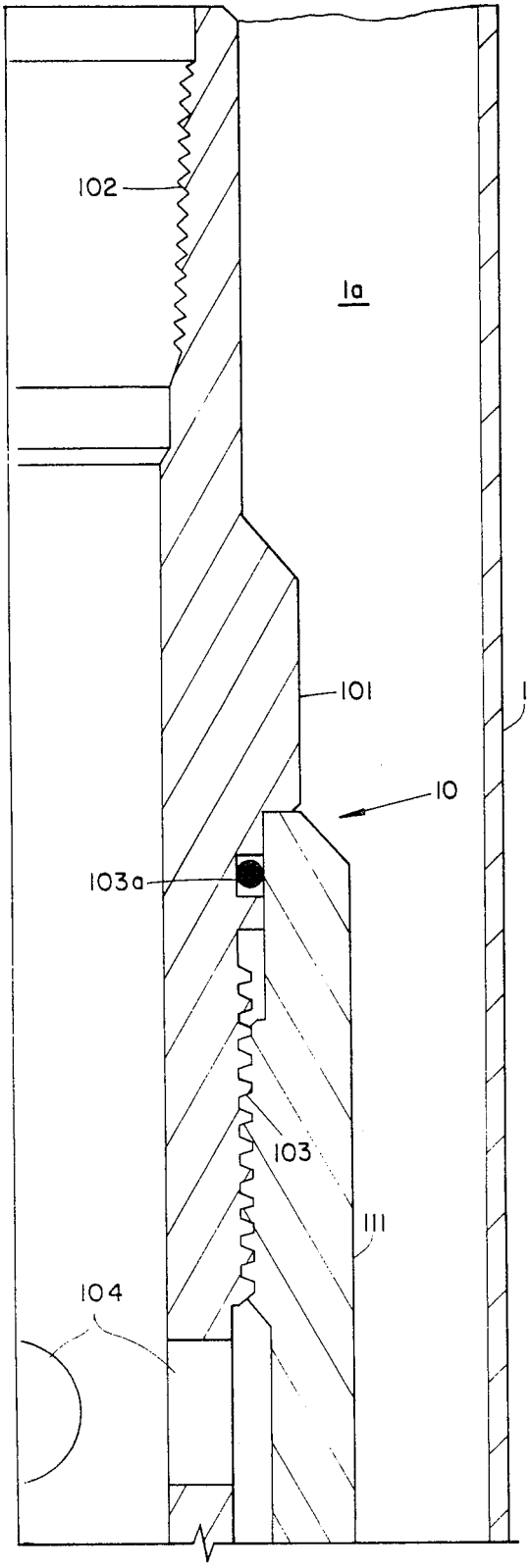
FIGS. 2A–2G collectively constitute an enlarged scale quarter sectional view of the apparatus shown in FIG. 1, with the elements thereof shown in their run-in positions.
Figure 2B:
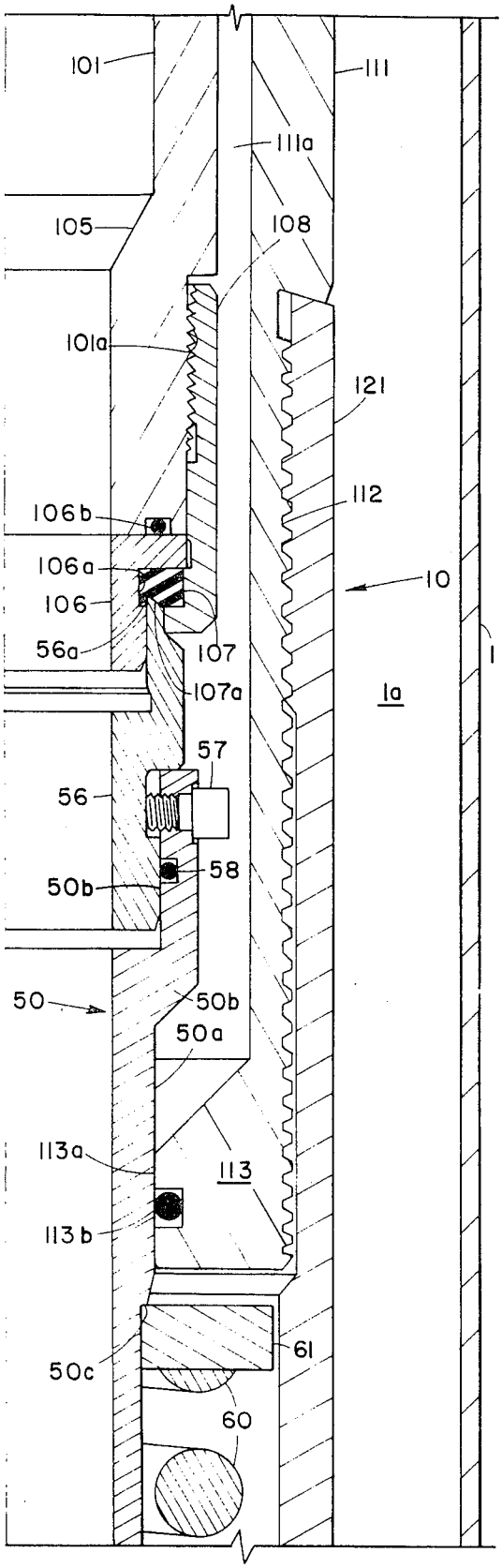
Figure 3B:
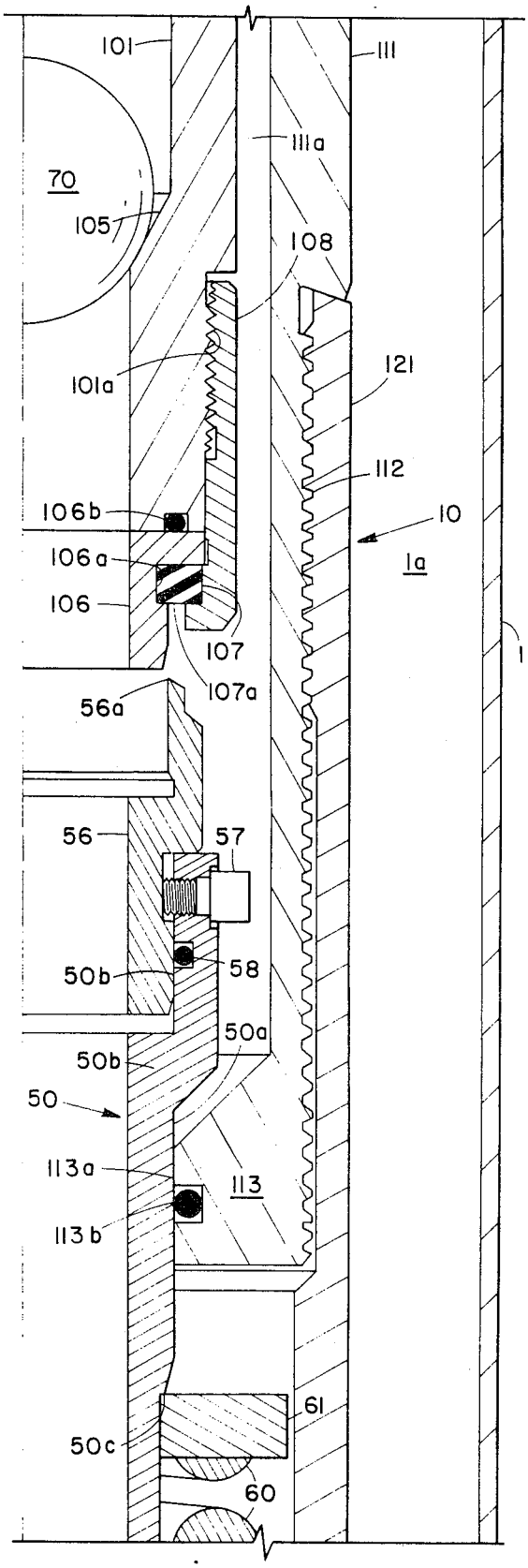
Figure 2C:
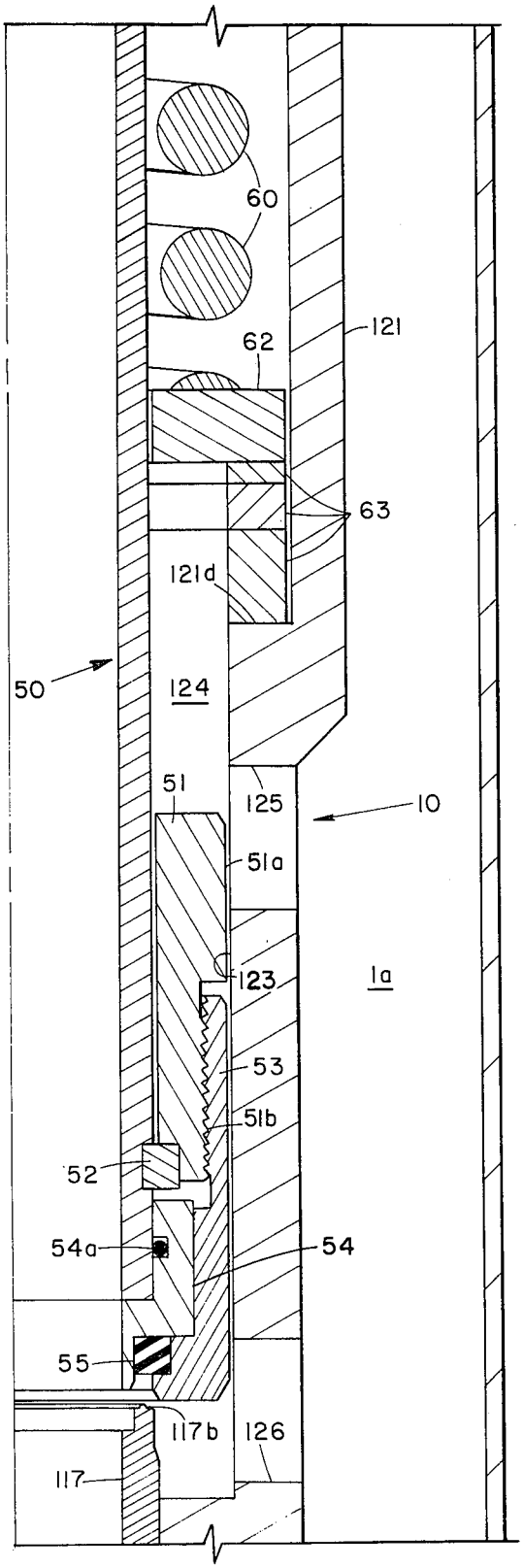
Figure 3C:
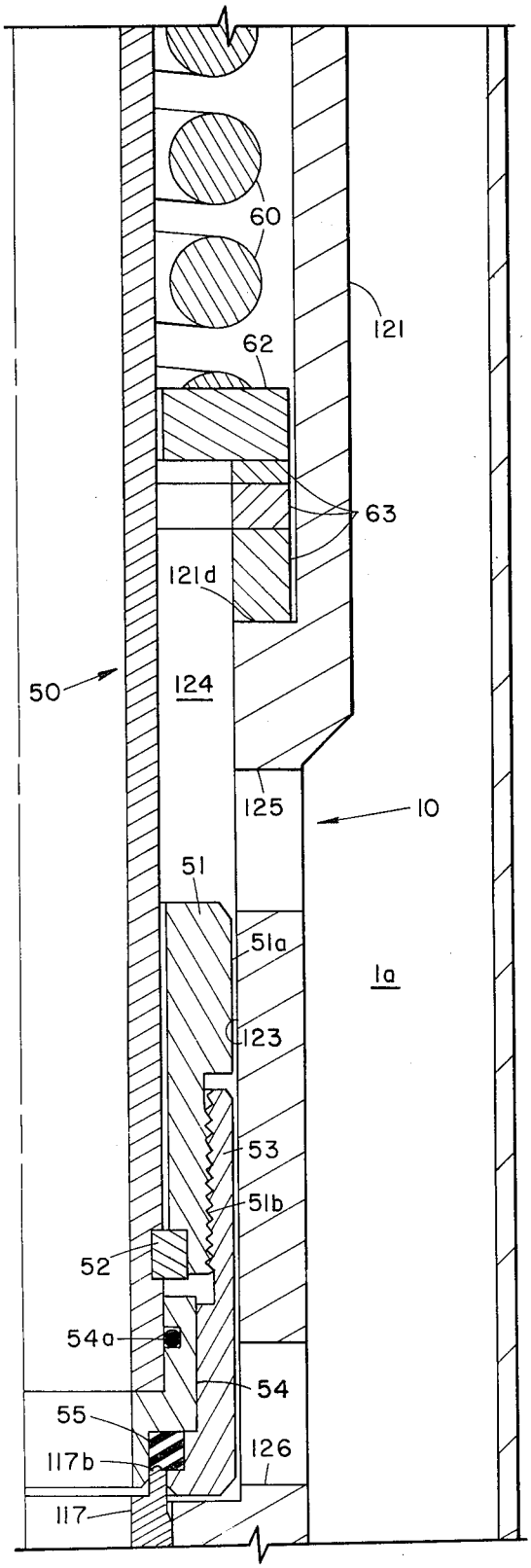
Figure 2D:
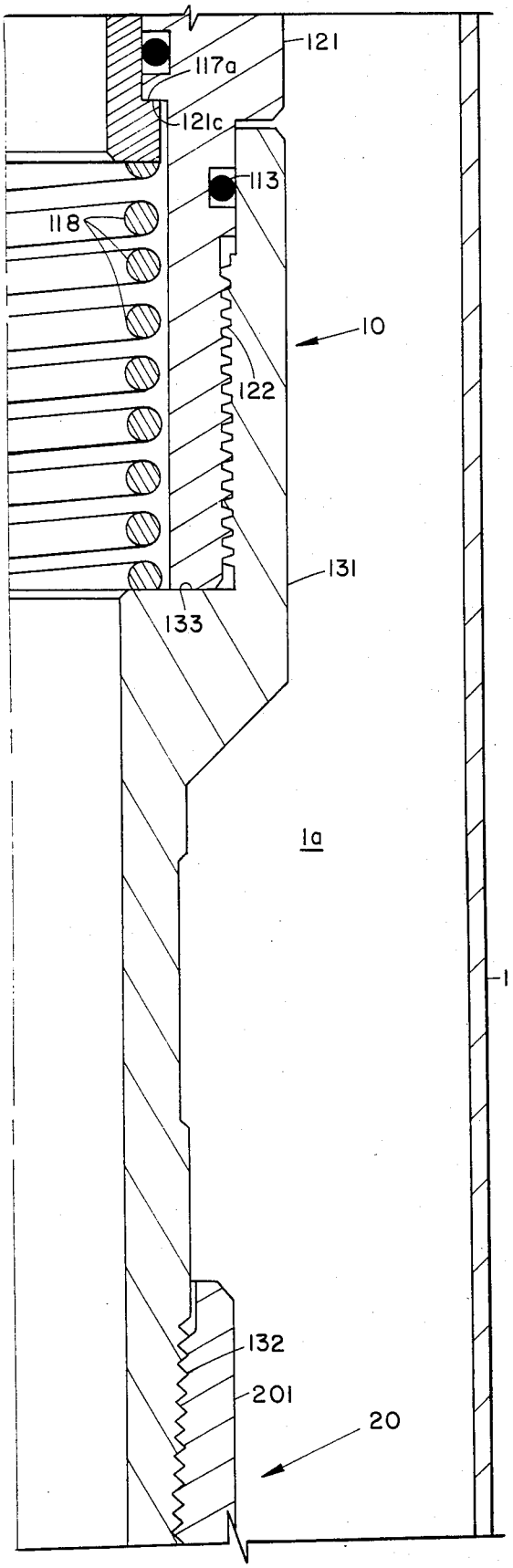
Figure 3D:
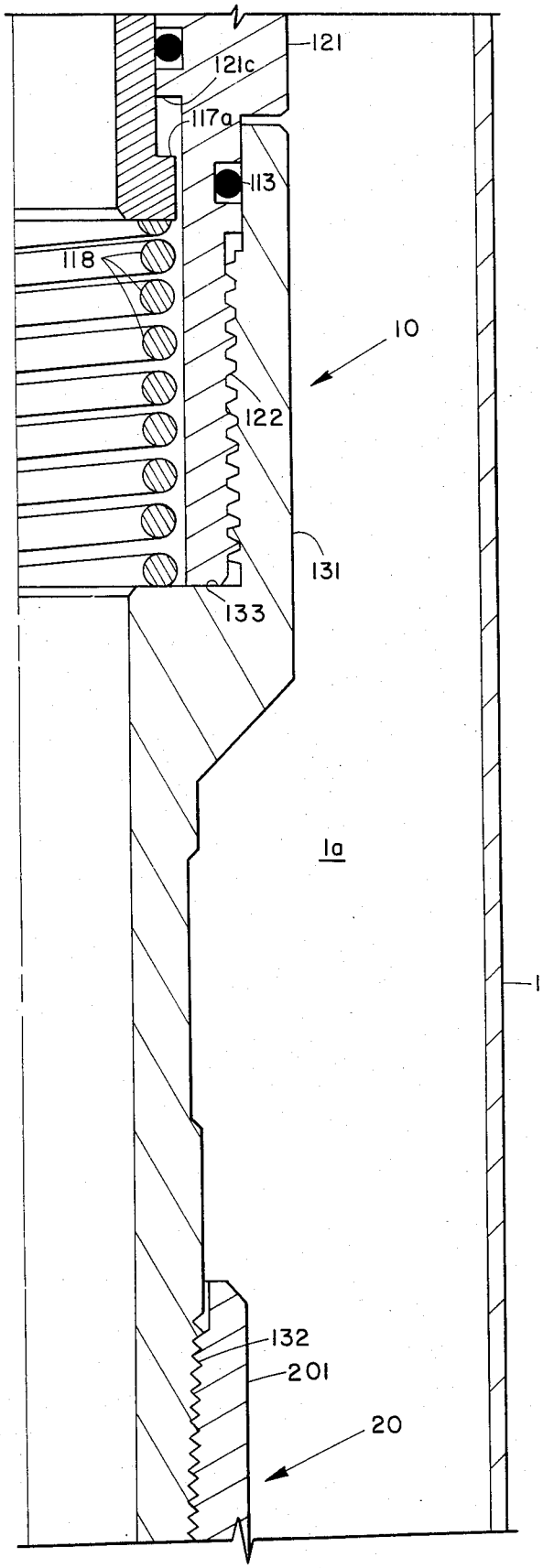
Figure 2E:
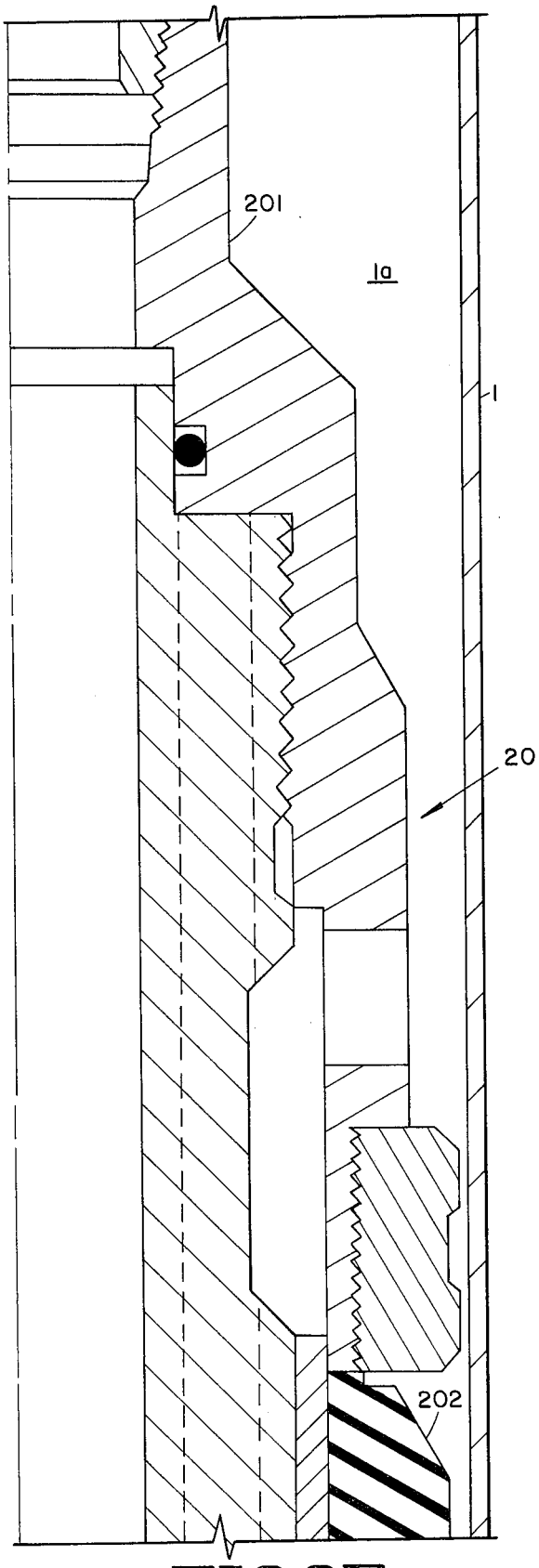
Figure 3E:
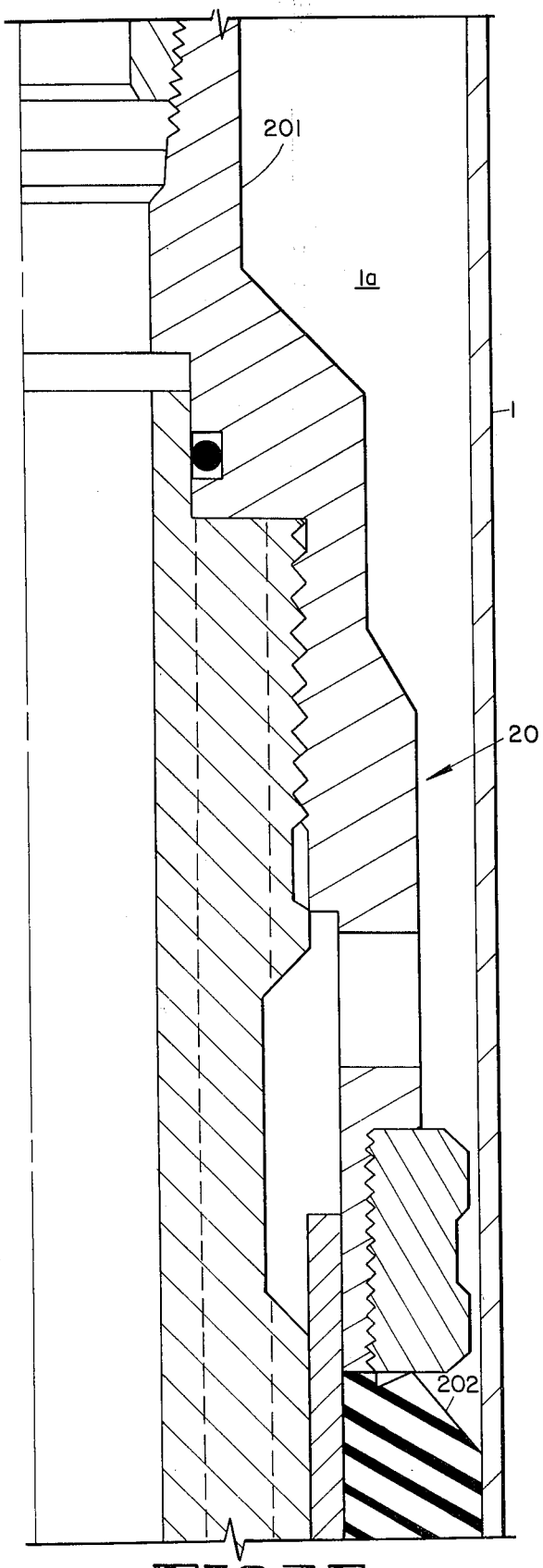
Figure 2F:
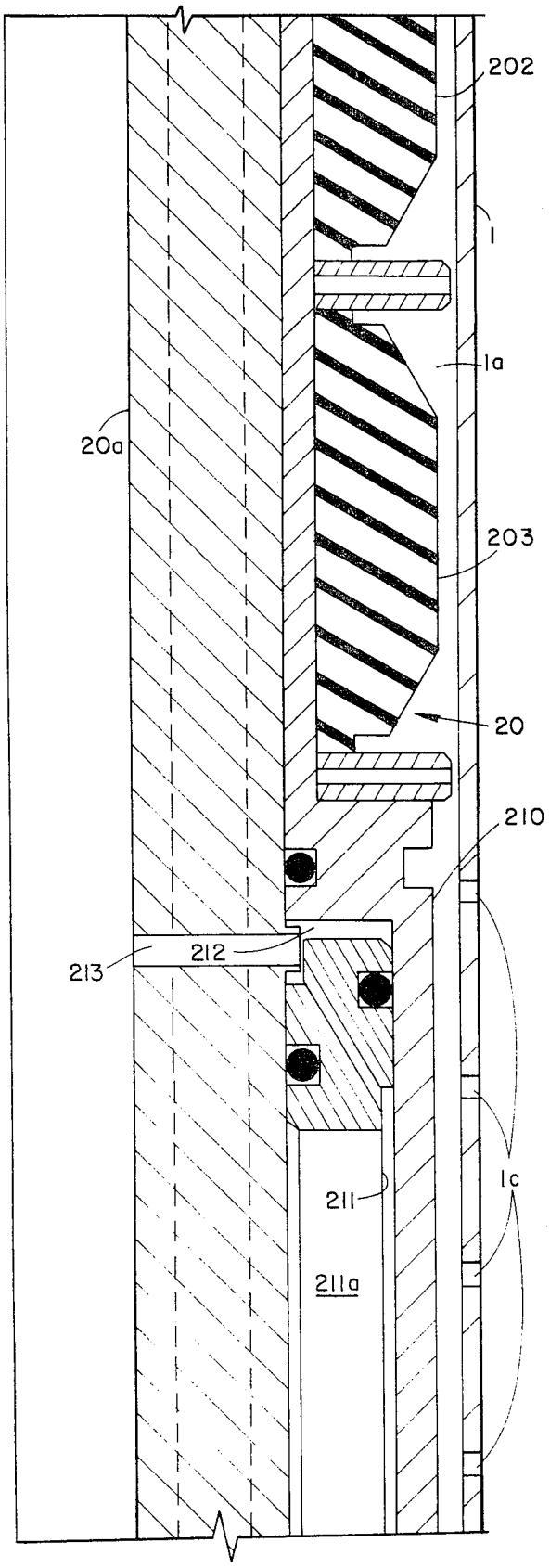
Figure 3F:
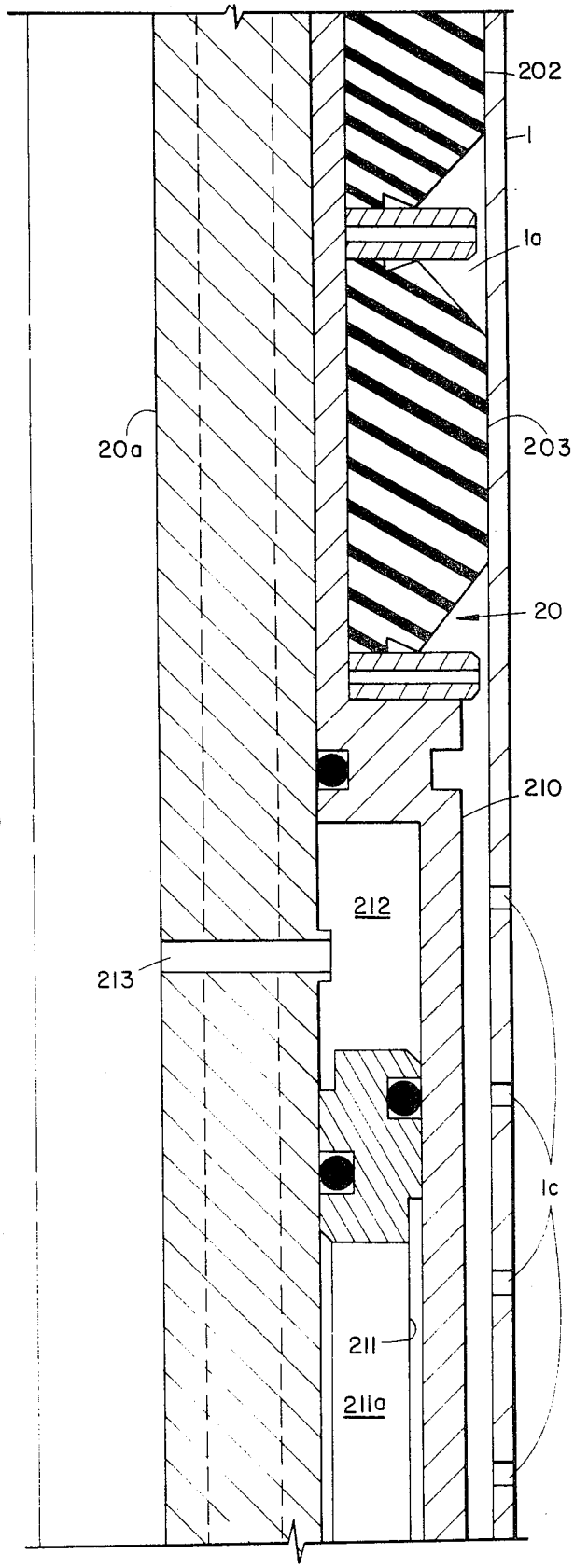
Figure 2G:
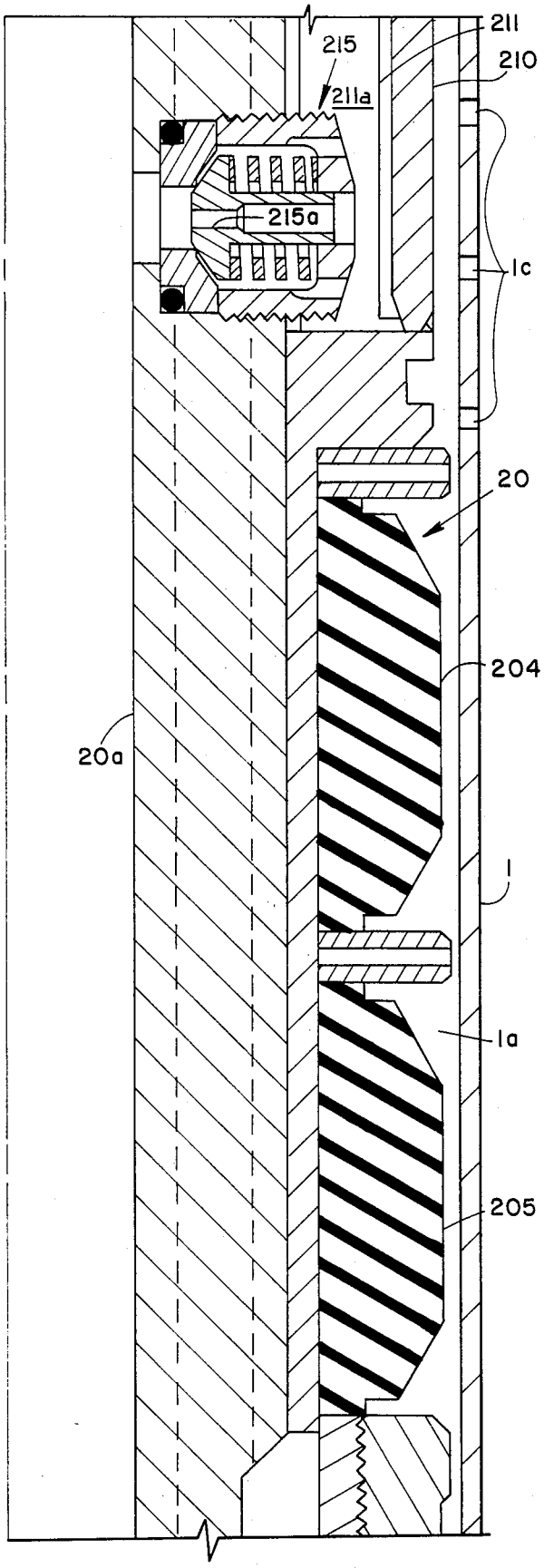
Figure 3G:
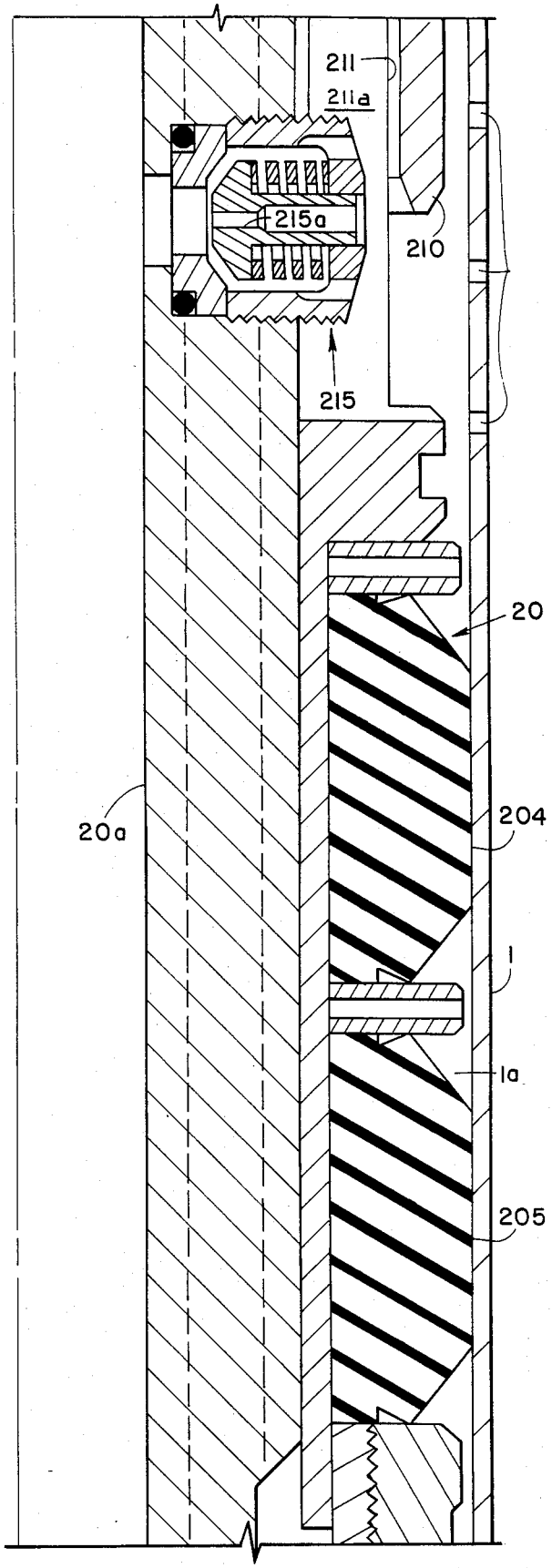

Ordinarily, the elastomeric elements 202–205 are expanded through the introduction of fluid pressure into the bore 20*a* of the washing tool 20 in excess of the hydrostatic pressure existing in the casing annulus 1*a*. A suitable valve (not shown) is provided in the bore 20*a* below port 213. If the annulus 1*a* is filled with fluid, the hydrostatic pressure existing in such annulus will generally be the same as the hydrostatic pressure existing within the bore 20*a*. As the pressure in the bore 20*a* is increased, the increased fluid pressure is applied through port 213 to the fluid pressure chamber 212, thus separating the telescopically related pistons 210 and 211 to exert a compressing force on the expandable elastomeric elements 202–205. Thus, the elastomeric elements 202–205 are compressed and displaced radially to move into sealing engagement with the inner wall of the casing 1, as illustrated in FIGS. 2E, 2F and 2G.

A conventional pressure relief valve 215 is provided in the wall of the washing tool 20 at a position adjacent the telescopically related pistons 210 and 211. In fact, the piston 211 is provided with an axial slot 211*a* (FIG. 1F) to receive the outer end of the pressure relief valve 215. Valve 215 is provided with a bleed passage 215*a* and is spring biased to a normally closed position. Upon a sufficient increase in fluid pressure after the setting of the expandable elastomeric elements 202–205, the pressure relief valve 215 will open and permit a large volume flow outwardly from the washing tool and through the selected set of perforations 1*c* in the casing wall 1 which is located between the innermost elastomeric sealing elements 203 and 204. Thus, a washing fluid can be injected through the perforations 1*c* into the fractures of the producing zone.

In a well where the hydrostatic casing annulus fluid pressure is equal to the hydrostratic pressure existing in the bore of the inner conduit, the washing operation can be discontinued and the elastomeric elements 202–205 released simply by terminating the application of fluid pressure to the work string. However, in those wells having a low fluid level, it often happens that the hydrostatic fluid pressure of the column of fluid contained in the interconnected work string and wash tool is substantially in excess of the ambient hydrostatic pressure existing in the casing annulus. In such event, it is not possible to effect the release of the expansible elastomeric packing elements 202–205 merely through reduction of the fluid pressure in the work string. The valving apparatus 10 involving this invention is specifically directed to resolving this problem, and it operates in the manner hereinafter described.

OPERATION

During run-in of the interconnected washing apparatus 20, valving apparatus 10 and work string 3, the interconnected bores of such apparatus are all open and hence, the apparatus may be freely entered into the well regardless of the height of the fluid therein. When the washing apparatus 20 or other apparatus incorporating a fluid pressure expansible packing element is positioned at its desired downhole location, the elements of the apparatus will be in their positions shown in FIGS. 2A–2G. A plug valve 70, generally comprising a ball, is then dropped through the interconnected bores to seat on the upwardly facing sealing surface 105 provided in the lower portion of uppermost tubular body element 101. Fluid pressure above the ball 105 is then increased at the well head and such increased fluid pressure flows outwardly through the radial port 104 into annulus 111*a* to bypass the ball valve 70. Such fluid pressure acts on the upwardly facing outer surfaces of the shuttle valve 50 and sleeve 56 and, since there is a greater area of upwardly facing surfaces on such elements than downwardly facing surfaces exposed to the higher fluid pressure flowing into annulus 111*a*, the sleeve 56 and shuttle valve 50 are forced downwardly. Such downward movement effects the opening of the sealing engagement between the upstanding annular sealing ridge 56*a* on shuttle valve 50 and the annular elastomeric mass 107, thus permitting the pressured fluid to flow within the bore of the tubular shuttle valve 50. Concurrently, the annular elastomeric mass 55 mounted on the bottom end of the shuttle valve 50 is moved into sealing engagement with the upstanding sealing ridge 117*b* provided in the lower portions of the lower intermediate body element 121. Thus the increased fluid pressure is applied through the bore of tubular shuttle valve 50 into the bore of the intermediate body element 121, thence, into the bore of the lower tubular body element 131 and into the bore 20*a* of the washing tool 20 to effect the expansion of the elastomeric packing elements 202–205 carried by the washing tool 20.

The washing operation then proceeds in normal manner with an appropriate fluid and, at the conclusion of the washing operation, the fluid pressure is removed at the surface from the bore of the work string 3 and the fluid pressure in the valve apparatus 10 returns to the normal hydrostatic pressure represented by the column of fluid contained in the work string 3 and the interconnected valving apparatus 10. The effective downward force on sleeve element 56 and shuttle valve 50 is thus removed and hence the shuttle valve 50 returns to its uppermost position, as illustrated in FIG. 2B, wherein the annular sealing ridge 56*a* is in sealing engagement with the annular elastomeric mass 107. More importantly, an annular gap is concurrently opened between the lower annular elastomeric sealing element 55 and the upstanding sealing ridge 117*b*. This gap permits a ready flow of fluid contained within the interconnected bore of the valving apparatus 10 and the work string 3 through such gap, through the radial ports 126, and into the casing annulus 1*a*, thus equalizing the fluid pressure in the casing annulus with that existing in the bore of the interconnected washing apparatus. This equalization of pressure permits the annular elastomeric packing elements 202–205 to contract through their normal resilience and return to their run-in positions illustrated in FIGS. 2E, 2F and 2G.

In summary, therefore, the method of operation embodied in this invention comprises supporting of a downhole tool having a fluid pressure actuated expandable packing element or a packing cup responsive to the differential pressure between the bore of the tool and the casing annulus pressure, on a valving apparatus which in turn is supported by a tubular conduit. A ball or similar conduit closure member is dropped into the tubular conduit to seat on an annular seating surface provided in the valving apparatus, thus supporting the hydrostatic fluid pressure of the conduit fluid. A bypass passage is provided in the valving apparatus around the ball and leading into a fluid pressure chamber wherein a shuttle valve is mounted and normally biased to an upper position by a spring. In such upper position, the lower end of the shuttle effects an opening of a passage between the bore of the supported downhole tool and the casing annulus, thus equalizing the fluid pressure therebetween.

Upon an increase in the conduit fluid pressure, the increased fluid pressure is transmitted to the fluid pressure chamber and produces a downward displacement of the shuttle valve against its spring bias to a lower position wherein the pressure equalizing passage is closed and a passage permitting conduit fluid pressure to flow into the downhole tool is established. Such increased fluid pressure effects the operation of the expandable packing element or packer cup on the downhole tool and, if the downhole tool is a perforation washer, the washing operation may be conducted so long as the conduit fluid pressure is maintained at the elevated level.

At the conclusion of the washing operation, the conduit fluid pressure is permitted to drop to the normal hydrostatic level, whereupon the shuttle valve in the valving apparatus is returned by its spring to its upper or normal position, thus establishing a fluid pressure equalizing passage between the bore of the downhole tool and the casing annulus, permitting the expandable packing element to contract.

It is therefore apparent that a valving apparatus embodying this invention provides a reliable supply of pressurized fluid to any pressure or flow actuated device, or a device responsive to pressure or flow disposed below the valving apparatus. At the same time, pressure equalization between the casing annulus and the bore of the interconnected work string and valving apparatus is effected when the fluid pressure in the interconnected work string, valving apparatus and bore of any device below the valving apparatus is returned to the normal hydrostatic level.

The valving apparatus disclosed herein can be employed with other than the wash tool disclosed herein which is responsive to a pressure differential between the tubing and the annulus. For example, a washing tool having cup type packing elements, rather than expandable packing elements as disclosed in the preferred embodiment, can also be responsive to pressure differentials in the tubing and the annulus. If this pressure differential is not unloaded or equalized, a washing tool employing conventional cup type packing elements cannot be axially shifted within the casing in the presence of tubing-annulus pressure differentials without damaging the cup type packing elements. Therefore, the invention disclosed herein can be employed with other pressure responsive well tools.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. The method of controlling fluid pressure on and flow to downhole tool means in a well having a low fluid level and consequently low hydrostatic pressure in the casing annulus, comprising the steps of:

(1) positioning a conduit closure member, supporting the hydrostatic pressure of fluid in the conduit, above a downhole tool means and above shiftable valve means having a biased normal position providing a pressure equalizing fluid passage between the bore of the downhole tool and the casing annulus;

(2) bypassing conduit fluid around the conduit closure member, so that conduit fluid acts against the bias of the shiftable valve means;

(3) increasing the conduit fluid pressure to shift the shiftable valve means against the bias to a second position, wherein the conduit fluid and fluid pressure are transmitted to the downhole tool; and (4) reducing the conduit fluid pressure to normal hydrostatic fluid pressure, thereby permitting said shiftable valve means to return to said normal position and equalize pressure in the conduit bore and the casing annulus and to stop flow down the fluid conduit.

2. The method of successively expanding and contracting fluid pressure actuated packing element means on conduit supported downhole tool means in a well having a low fluid level and consequent low hydrostatic fluid pressure in the casing annulus, comprising the steps of:

(1) positioning a conduit closure member, supporting the hydrostatic pressure fluid in the conduit, above a downhole tool means and above shiftable valve means having a biased normal position providing a pressure equalizing fluid passage between the bore of the downhole tool and the casing annulus;

(2) bypassing conduit fluid around the conduit closure member, so that conduit fluid acts against the bias of the shiftable valve means;

(3) increasing the conduit fluid pressure to shift the shiftable valve means against the bias to a second position, wherein the conduit fluid pressure is transmitted to the bore of the downhole tool to expand the packing element means; and (4) reducing the conduit fluid pressure to normal hydrostatic fluid pressure, thereby permitting said shiftable valve means to return to said normal position and equalize pressure in the tool bore and the casing annulus to permit contraction of the packing element means.

3. Fluid pressure responsive valving apparatus for an annular downhole tool having a central bore and at least one packing element expandable into sealing relation with the casing wall by a fluid pressure differential between the tool bore and the casing annulus, comprising: a tubular assembly connectable in series relation between a surface connected well conduit and the downhole tool, said tubular assembly having a first fluid passage communicating with said tool bore and port means communicating between the bore of the tubular assembly and the casing annulus; a valve shiftably mounted in said tubular assembly for movement between two positions; said valve in said first position connecting the bore of said downhole tool to the casing annulus through said port means; resilient means urging said valve to said first position; said valve in said second position directing conduit fluid pressure through said first and second fluid passages into the bore of the downhole tool to expand the packing element thereof; and means responsive to the conduit fluid pressure for shifting said valve to said second position against the bias of said resilient means.

4. The valving apparatus of claim 3 wherein an annular valve seat is mounted in surrounding relation to the bore of said tubular assembly above said shiftable valve; a valve element positionable on said annular valve seat after insertion of said tool in the well; and bypass fluid passage means in said tubular assembly for directing conduit fluid pressure above said valve element into a fluid pressure chamber containing said means responsive to the conduit fluid pressure.

5. Fluid pressure responsive valving apparatus for a first subterranean well conduit defining an annulus within a second conduit comprising, in combination: a tubular assembly connectable in series relation with the first well conduit and a downhole tool; an upper annular valve surface mounted in said tubular assembly; a lower annular valve surface mounted in said tubular assembly below said upper annular valve surface; a tubular valving shuttle axially shiftably mounted in said tubular assembly and having axially spaced, upper and lower annular valve surfaces respectively sealingly engageable with said upper and lower valve surfaces on said tubular assemblage upon upward and downward movement of the valving shuttle; resilient means urging said valving shuttle, thereby creating a fluid flow gap between said lower valve surfaces; a radial port in said tubular assemblage communicating between said gap and the annulus; means in said tubular assembly defining a fluid pressure chamber sealably cooperating with said valving shuttle; means in the bore of said tubular assembly above said upper annular valve surface for receiving a valve element to permit fluid pressure in the first conduit to be increased; and fluid passage means for supplying said increased fluid pressure to said fluid pressure chamber, thereby forcing said valving shuttle downwardly to sealingly engage said lower annular valve surface and transmit said increased fluid pressure to the downhole tool.

6. The apparatus of claim 5 wherein one of said upper annular valve surfaces is defined by a first annular elastomeric mass, and one of said lower annular valve surfaces is defined by a second annular elastomeric mass.

7. The apparatus of claim 6 wherein said first annular elastomeric mass is mounted on said tubular assembly and said second annular elastomeric mass is mounted on said valving shuttle.

8. The apparatus of claim 6 wherein the other of said upper annular valve surfaces comprises an axially upstanding ridge having indenting engagement with said first annular elastomeric mass, and said other of said lower annular valve surfaces comprises an axially upstanding ridge having indenting engagement with said second annular elastomeric mass.

9. The apparatus of claim 8 wherein said first annular elastomeric mass is mounted on said tubular assembly and said second annular elastomeric mass is mounted on said valve shuttle.

10. The apparatus of claim 5 wherein said lower annular valve surface comprises an upstanding annular ridge formed on a sleeve slidably and sealably mounted in said tubular assembly; a spring urging said sleeve upwardly against a stop surface on said tubular assembly; and an annular mass of elastomeric material mounted on the bottom end of said shuttle valve to sealingly engage said upstanding annular ridge.

11. Fluid pressure responsive valving apparatus for a first subterranean well conduit defining an annulus within a second conduit comprising, in combination: a tubular assembly connectable in series relation with the first well conduit and a downhole tool; an upper annular valve surface mounted in said tubular assembly; a lower annular valve surface mounted in said tubular assembly below said upper annular valve surface; a tubular shuttle valve vertically shiftably mounted in said tubular assembly and sealingly engagable with said upper annular valve surface in an upper position and with said lower annular valve surface in a lower position; resilient means urging said shuttle valve to the upper position; means responsive to fluid pressure in the first conduit for moving said tubular shuttle valve to said lower position; and port means in said tubular assembly adjacent said lower annular valve surface; whereby fluid pressure in said annulus is equalized with fluid pressure in said first conduit whenever said shuttle valve is in its said upper position.

12. The apparatus of claim 11 further comprising valve means in said tubular assembly for closing the bore of said first conduit at a position above said upper annular valve surface, thereby permitting fluid pressure in said first conduit to be increased above said valve means; an upwardly facing piston surface on said shuttle valve; and fluid passage means for directing said increased fluid pressure to impinge on said piston surface and force said shuttle valve downwardly, thereby permitting downward flow of said increased fluid pressure to the downhole tool.

13. The apparatus of claim 12 wherein said upper annular valve surface comprises an annular mass of elastomeric material and said tubular shuttle valve has top end surface engagable with said elastomeric mass and defining said annular piston surface.

14. The apparatus of claim 13 wherein said lower annular valve surface comprises an upstanding annular ridge formed on a sleeve slidably and sealably mounted in said tubular assembly; a spring urging said sleeve upwardly against a stop surface on said tubular assembly; and an annular mass of elastomeric material mounted on the bottom end of said shuttle valve to sealingly engage said upstanding annular ridge.

15. In a subterranean well having a fluid conduit disposed in a casing to define an annulus, and an annular fluid pressure actuated packing element disposed in said annulus and expandable into sealing relationship between the casing and fluid conduit by an increase in the fluid pressure in the conduit above that in the annulus, the improvement comprising: a control valve apparatus connectable in the conduit above the annular packing element; said control valve apparatus comprising a pair of axially spaced, downwardly and upwardly facing annular sealing surfaces; a tubular element mounted intermediate said annular sealing surfaces for vertical axial movement; said tubular element having an upper annular sealing surface engagable with said downwardly facing sealing surface at an upper position of said tubular element, thereby producing a pressure equalizing gap above the second upwardly facing sealing surface; said tubular element having a lower annular sealing surface engagable with said second upwardly facing sealing surface in a lower position of said tubular element; resilient means urging said tubular element to said upper position; and means responsive to an increase in fluid pressure in the conduit for concurrently shifting said tubular element to said lower position and supplying said fluid pressure through said tubular conduit to the annular packing element to expand same, whereby removal of said increased fluid pressure in the conduit permits said tubular element to return to said upper position and equalize annulus pressure on the expanded packing element with conduit pressure through said pressure equalizing gap.

16. In a subterranean well having a fluid conduit disposed in a casing to define an annulus, and an annular fluid pressure actuated packing element disposed in said annulus and expandable into sealing relationship between the casing and fluid conduit by an increase of fluid pressure in the conduit above that in the annulus, the improvement comprising: a control valve apparatus connectable in the conduit above the annular packing element; said control valve apparatus comprising a pair of axially spaced, annular sealing surfaces; a shuttle valve vertically shiftably mounted in said tubular assembly and sealingly engagable with said upper annular valve surface in an upper portion and with said lower annular valve surface in a lower position; resilient means urging said shuttle valve to its upper position; means responsive to fluid pressure in the fluid conduit for shifting said shuttle valve to said lowermost position; and port means in said tubular assemblage adjacent said lower annulus is equalized with fluid pressure in said first conduit whenever said shuttle valve is in its said uppermost position.

17. The apparatus of claim 16 further comprising valve means in said tubular assemblage for closing the bore of said first conduit at a position above said upper annular valve surface; thereby permitting fluid pressure in said first conduit to be increased above said valve means; an upwardly facing piston surface on said shuttle valve; and fluid passage means for directing said increased fluid pressure to impinge on said piston surface and force said shuttle valve downwardly, thereby permitting downward flow of said increased fluid pressure to the downhole tool.

18. The apparatus of claim 17 wherein said upper annular valve surface comprises an annular mass of elastomeric material and said tubular shuttle valve has a top end surface engagable with said elastomeric mass and defining said annular piston surface.

19. The apparatus of claim 18 wherein said lower annular valve surface comprises an upstanding annular ridge formed on a sleeve slidably and sealably mounted in said tubular assembly; a spring urging said sleeve upwardly against a stop surface on said tubular assembly; and an annular mass of elastomeric material mounted on the bottom end of said shuttle valve to sealingly engage said upstanding annular ridge.

* * * * *